US005582398A

United States Patent [19]

Long

[11] Patent Number: 5,582,398

[45] **Date of Patent: *Dec. 10, 1996**

[54] APPARATUS AND METHOD FOR FEEDING PRODUCTS FROM SELECTED PRODUCT STACKS

[76] Inventor: John A. Long, 41 Lamont Avenue, Scarborough, Ontario, Canada, M1S 1A8

[ * ] Notice: The term of this patent shall not extend beyond the expiration date of Pat. No. 5,402,996.

[21] Appl. No.: 387,051

[22] Filed: Feb. 10, 1995

Related U.S. Application Data

[63] Continuation-in-part of Ser. No. 197,028, Feb. 16, 1994, Pat. No. 5,402,996.

[51] Int. Cl.[6] ..... B65H 3/44

[52] U.S. Cl. ..... 271/9.12; 271/9.01; 271/35; 271/110

[58] Field of Search ..... 271/9.01, 9.12, 271/35, 125, 122, 110, 114, 10.03, 10.04, 10.07; 221/131

[56] References Cited

U.S. PATENT DOCUMENTS

| | | | |
|---|---|---|---|
| 2,583,471 | 1/1952 | Collis | 198/835 |
| 3,291,286 | 12/1966 | Adams | 198/835 |
| 3,291,287 | 12/1966 | Rehm | 198/835 |
| 3,625,803 | 12/1971 | Masulis . | |
| 3,981,493 | 9/1976 | Klappenecker et al. | 271/114 |
| 4,157,822 | 6/1979 | Miller | 271/9.12 |
| 4,651,983 | 3/1987 | Long . | |
| 4,966,357 | 10/1990 | Burger | 271/35 |
| 5,129,641 | 7/1992 | Long | 271/35 |
| 5,141,216 | 8/1992 | Pallestrazzi et al. | 271/9 |
| 5,385,509 | 1/1995 | Long . | |
| 5,402,996 | 4/1995 | Long | 271/35 |
| 5,415,386 | 5/1995 | Belec et al. | 271/9.01 |

FOREIGN PATENT DOCUMENTS

| | | | |
|---|---|---|---|
| 1235096 | 5/1963 | Germany | 198/835 |
| 1402513 | 6/1988 | U.S.S.R. | 198/835 |

*Primary Examiner*—H. Grant Skaggs

[57] ABSTRACT

A number of product feeders comprise a conveyor underlying a friction wheel operated by a pulsed drive. A continuously rotating drive shaft is coupled to a selected feeder by a controller coupling a drive wheel on the drive shaft with a drive transmission wheel associated with the conveyor of the feeder. This may be effected by an air cylinder of the feeder operating under control of the controller to move the drive transmission wheel into a position whereat it is driven by the drive wheel. Alternatively, the drive wheel may be clutched under control of the controller. The pulsed friction wheel rotates through an arc in order to drop a product from a stack of products partially supported by the friction wheel onto the now moving conveyor. A downstream product sensor, when sensing that a product has been delivered, signals the controller so that the controller decouples the conveyor from the drive shaft.

21 Claims, 6 Drawing Sheets

APPARATUS AND METHOD FOR FEEDING PRODUCTS FROM SELECTED PRODUCT STACKS

CROSS-REFERENCE TO RELATED APPLICATIONS

This application is a continuation-in-part of U.S. patent application Ser. No. 197,028 filed Feb. 16 1994, now U.S. Pat. No. 5,402,996 issued Apr. 4, 1995.

BACKGROUND OF THE INVENTION

1. Field of the Invention

This invention relates to apparatus and a method for selectively feeding products singly from a plurality of stacks thereof.

2. Description of the Related Art

My U.S. Pat. No. 4,651,983 which issued Mar. 24, 1987 describes a card feeder for selectively feeding cards from a stack thereof. Where it is desired to feed from more than one stack, for example, when selected inserts are to be fed onto a conveyor, multiple ones of such feeders may be employed and coordinated with a common controller. However, this provides an expensive solution.

Accordingly, there remains a need for a cost effective manner of selectively feeding products from a plurality of product stacks.

SUMMARY OF THE INVENTION

According to the present invention, there is provided apparatus for selectively feeding products from a plurality of stacks thereof, comprising, a plurality of stack guides;

a single drive for continuously rotating; associated with each stack guide of said plurality of stack guides, a conveyor, a friction wheel spaced above said conveyor so as to provide a gap through which products may be singly fed from the bottom of a stack of products supported by said stack guide, means to pulse said friction wheel, and means, when in a first state, coupling said conveyor to said continuously rotating drive in order to drive said conveyor and, when in a second state, decoupllng said conveyor from said continuously rotating drive; and controller for selectively causing a said coupling means associated with a stack guide of said plurality of stack guides to enter said first state, whereby said single drive is a common drive for each said conveyor.

In accordance with another aspect of this invention, there is provided a method of selectively feeding products from a plurality of product feeders of the type having a stack of products, comprising the following steps, continuously rotating a drive shaft having a plurality of drive wheels mounted for rotation therewith; selecting at least one feeder and moving a drive transmission wheel operatively associated with a conveyor of each selected feeder such that said drive transmission wheel moves into a driven relationship with an associated one of said plurality of drive wheels and is thereby driven; stepping a friction wheel spaced above the conveyor of each selected feeder so that a product from a stack of products associated with said friction wheel is fed from the bottom of said stack into a gap between said friction wheel and said conveyor.

BRIEF DESCRIPTION OF THE DRAWINGS

In the figures which disclose example embodiments of the invention.

DESCRIPTION OF THE PREFERRED EMBODIMENTS

Figure 1:
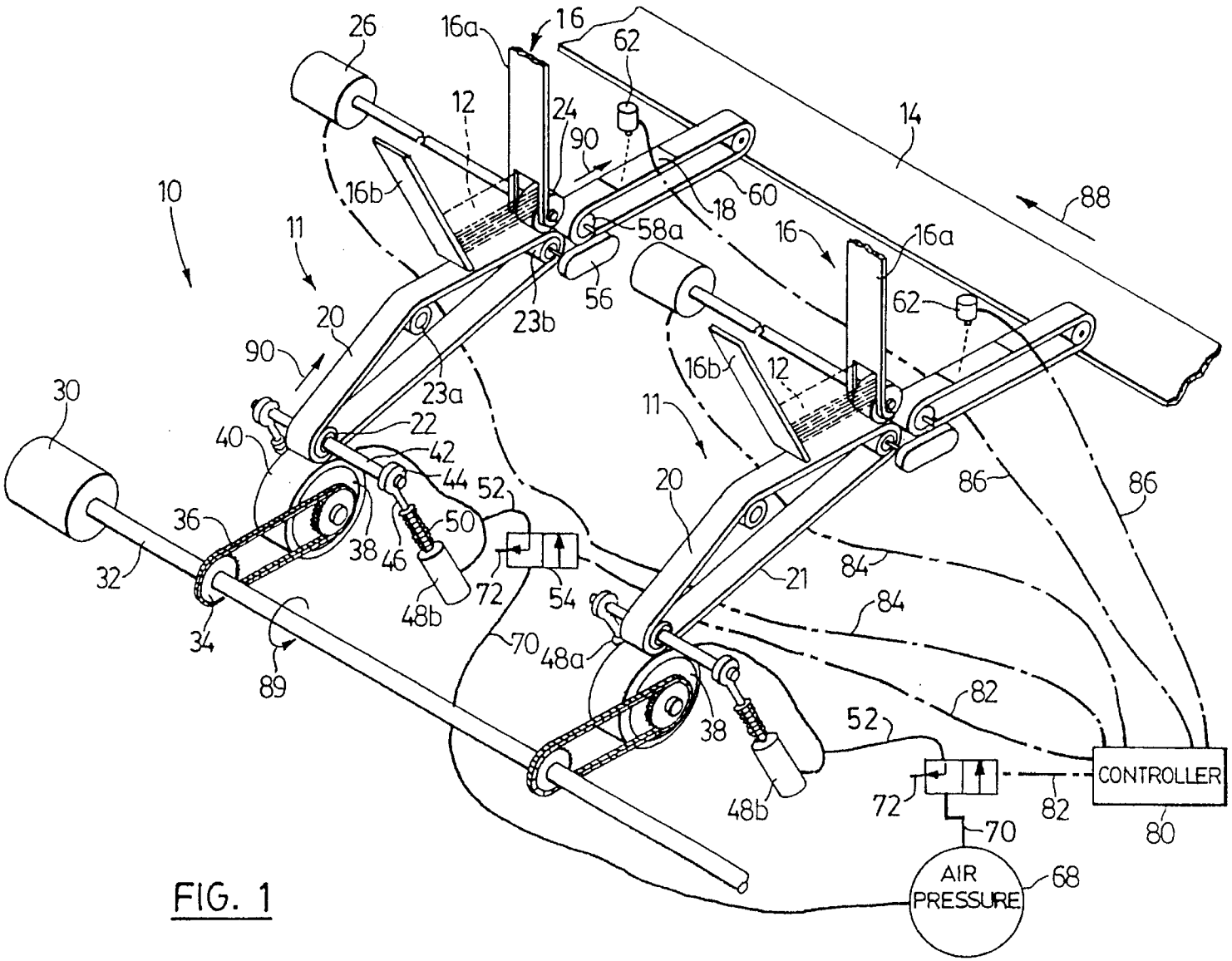
FIG. 1 is a perspective view of apparatus made in accordance with this invention.

With reference to FIG. 1, 10 designates generally apparatus made in accordance with this invention for selectively feeding products 18 from a plurality of stacks 12 of products to a conveyor 14. The apparatus 10 comprises a plurality of feeders 11, each with a stack guide 16 for a stack 12 of products. The stack guides have a front guide plate 16*a* and a rear guide plate 16*b*. For each feeder 11, a conveyor 20 is positioned below stack guide 16. The conveyor 20 has an upstream feed belt 21 riding on guide wheels 23*a*, 23*b* and on a resilient faced drive transmission wheel 22 such that the feed belt has a generally triangular configuration. A friction wheel 24 is received within a notch of the front guide plate 16*a* so that the lower front edge of each stack 12 of products is in contact with the friction wheel 24. The friction wheel is spaced above conveyor 20 in order to provide a gap between it and the conveyor 20. A stepping motor 26 is connected to each friction wheel.

Each drive transmission wheel 22 is supported by a shaft 42 which is mounted on ring bearings 44. The pistons 46 of each cylinder 48*a*, 48*b* is coupled to one of the ring bearings 44. A spring 50 on each piston urges the piston to an extended position. Air line 52 connects a two position valve 54 to cylinders 48*a*, 48*b*. Valve 54 has a port 72 to atmosphere.

Conveyor 20 comprises a downstream feed belt 60 as well as upstream feed belt 21. Guide wheel 23*b* of feed belt 21 is connected through transmission 56 to guide wheel 58*a* of downstream feed belt 60. A product sensor 62 overlies downstream feed belt 60. The downstream feed belt 60 extends between feed belt 21 and conveyor 14.

Apparatus 10 has a drive motor 30 with a drive shaft 32. Spur gears 34 and chain belts 36 couple the drive shaft 32 to drive wheels 38. Each drive wheel has a resilient face 40. One drive wheel is provided for each feeder 11 and underlies drive transmission wheel 22. Apparatus 10 includes an air pressure source 68 connected to each two position valve 54 by an air line 70. A controller 80 is connected to the control line 82 of each valve 54 as well as to the control line 84 of each stepping motor 26. The signal output line 86 of each product sensor 62 is fed to controller 80.

In describing the operation of the apparatus 10, it is assumed that the starting position for the apparatus is shown in FIG. 1 with a product 18 positioned on each downstream feed belt 60 under product sensor 62. Conveyor 14 conveys in a downstream direction 88. Drive motor 30 continuously rotates drive shaft 32, and therefore drive wheels 38, in a counterclockwise direction 89. Information is fed to controller 80 to dispense products from certain feeders 11 at certain times. Based on this information, controller 80 sends valve actuation signals on selected ones of valve control lines 82 in order to couple the source of air pressure 68 to the cylinders 48*a*, 48*b* of selected feeders. This causes the pistons 46 of these cylinders to retract thereby translating the drive transmission wheels 22 of the selected feeders so that the feed belts 21 of these feeders are brought into contact with the resilient face 40 of an underlying drive wheel 38. The drive wheel 38 therefore acts to drive both the drive transmission wheel 22 and the conveyor 20. The conveyor 20 of each selected feeder is driven in a downstream direction 90 causing the product 18 on the downstream feed belt 60 of the conveyor 20 to be dispensed to conveyor 14.

At about the same time as issuing a control signal on valve control lines 82 of selected feeders, the control let issues control signals on lines 84 to these feeders such that the stepping motors of each selected feeder rotates the feeder's friction wheel 24 through an arc sufficient to separate the bottom products in the stack and ensure that the bottom-most product is dropped from the stack 12 of products onto feed belt 21. Once on feed belt 21, the product moves along the feed belt through the gap between the friction wheel 24 and along downstream feed be it 60. When the travelling product 18 interrupts product sensor 62 of a feeder 11, the product sensor sends a signal on the line 86 to the controller 80. This prompts the controller to send a signal on line 82 to the valve 54 associated with the same feeder in order to operate the valve to couple the vent 72 to cylinders 48*a*, 48*b*. When cylinders are vented, springs 50 cause the pistons 46 of the cylinders to extend in order to move the drive transmission wheel 22 and feed belt 21 out of contact with drive wheel 38. In this way, the conveyor 20 of the feeder 11 is stopped with a product 18 on downstream feed belt 60 of the conveyor ready for dispensing when that feeder is again selected.

In summary, when the controller activates a feeder 11, the feeder dispenses a product 18 which had been resting on feed belt 60 to conveyor 14, dispenses another product from stack 12, and continues to operate until this other product reaches a pre-determined location whereat it interrupts product sensor 62 on feed belt 60.

When stacks 12 of products are first placed within the stack guide 16 of each product feeder 11, the controller may be prompted to activate each product feeder in order to feed a product from the stack and along the downstream feed belt 60 until the product interrupts product sensor 62, as shown in FIG. 1. The apparatus 10 is then ready for operation as described hereinbefore.

While FIG. 1 shows only two product feeders 11, obviously as many product feeders 11 as desired may be added with a drive wheel 38 being provided for each product feeder 11.

A wide range of products may be fed by feeders 11 of apparatus 10 such as cards, brochures, floppy disks, or paper money. Furthermore, by modifying feed belt 21 of conveyor 20 to provide a more resilient surface (such as a surface comprised of resilient plastic fingers), feeders 11 could feed stacks of products having a greater three-dimensionality, such as hand calculators or cellophane wrapped miniature toys.

Figure 2:
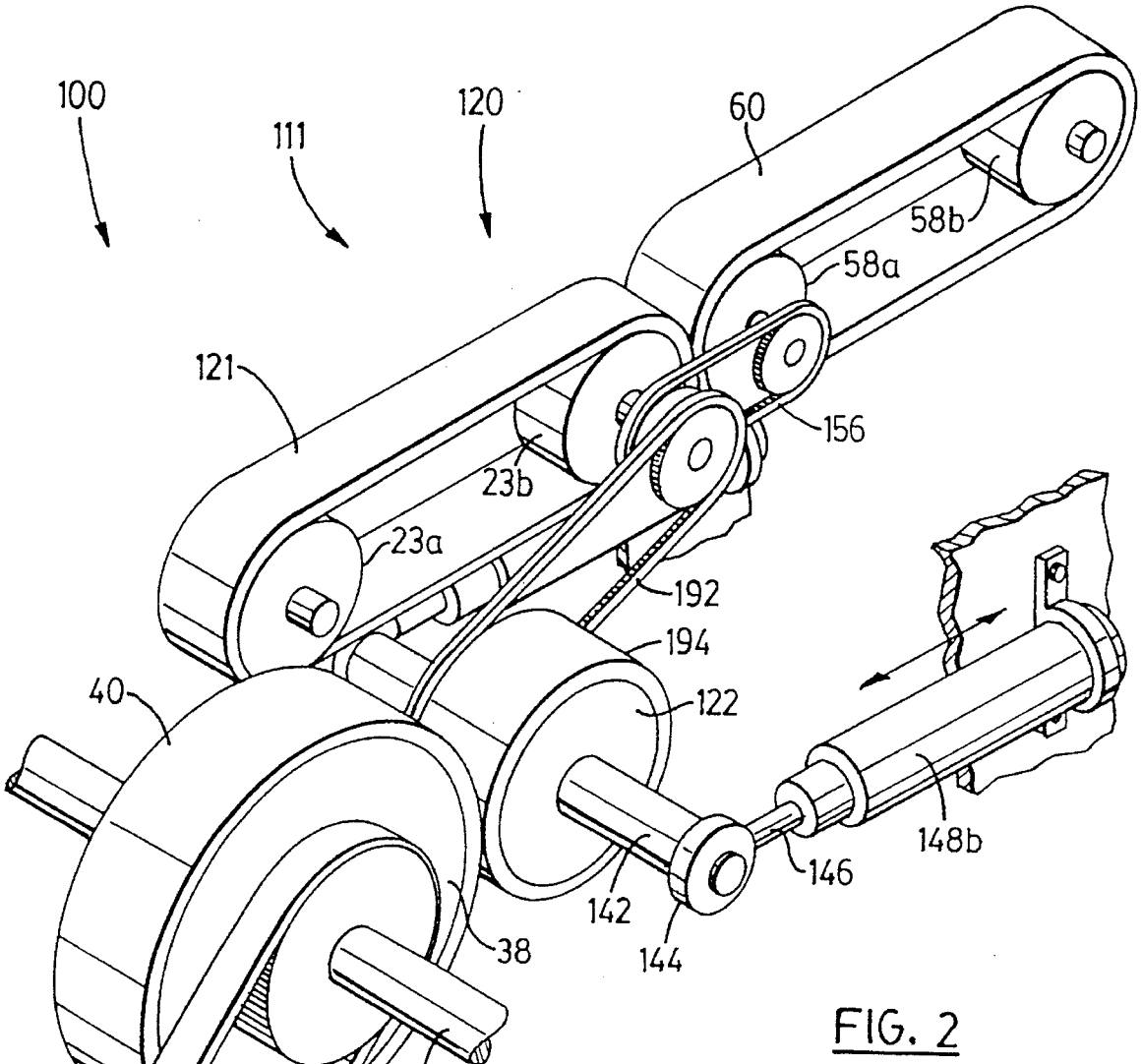
FIG. 2 is a fragmentary perspective view of apparatus made in accordance with another aspect of this invention.

FIG. 2 illustrates a modification of the apparatus of FIG. 1. Turning to FIG. 2, wherein like numbers have been given to like parts of FIG. 1, apparatus 100 comprises feeders 111 having a conveyor 120 with an upstream feed belt 121 running on guide wheels 23*a*, 23*b* and a downstream feed belt 60 running on guide wheels 58*a*, 58*b*. A transmission belt 156 couples the guide wheel 58*a* to guide wheel 23*b*. Guide wheel 23*b* is also coupled to drive transmission wheel 122 by flexible transmission belt 192. The drive transmission wheel 122 rides on a shaft 142 supported by ring bearings 144 which terminate pistons 146 of air cylinders 148*a*, 148*b*. The piston of each air cylinder is biased to a retracted position shown in FIG. 2*a* by an internal spring in each cylinder (not shown). A drive wheel 38, which is motivated by belt 136, is mounted on shaft 139 adjacent feeder 111. The balance of apparatus 100, being identical to apparatus 10 of FIG. 1, has not been shown.

Figure 2A:
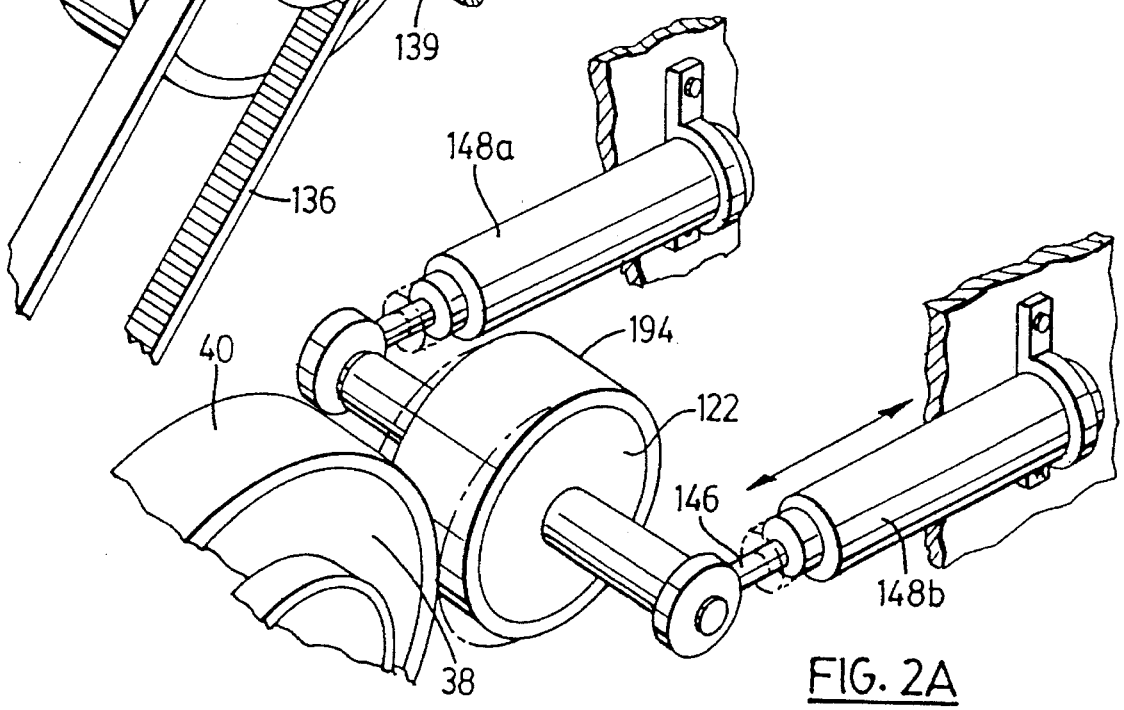
FIG. 2*a* is a fragmentary perspective view of the apparatus of FIG. 2 showing an aspect of the operation of the apparatus.

In operation of apparatus 100, when air cylinders 148*a*, 148*b* of a feeder 111 are vented to atmosphere, drive transmission wheel 122 is in the position shown in FIG. 2*a*, spaced from drive wheel 38, and the conveyor 120 is stationary. The controller (not shown) may operate a particular feeder 111 by coupling an air pressure source to the cylinders 148*a*, 148*b* of the feeder such that the pistons 146 of the cylinders extend until the resilient face 194 of the drive transmission wheel 122 abuts the resilient face 40 of drive wheel 38, as shown in FIG. 2. Transmission belt 192 stretches to accommodate the movement of the drive transmission wheel. With the drive transmission wheel abutting the drive wheel, the drive transmission wheel, and therefore conveyor 120, is driven.

Figure 3:
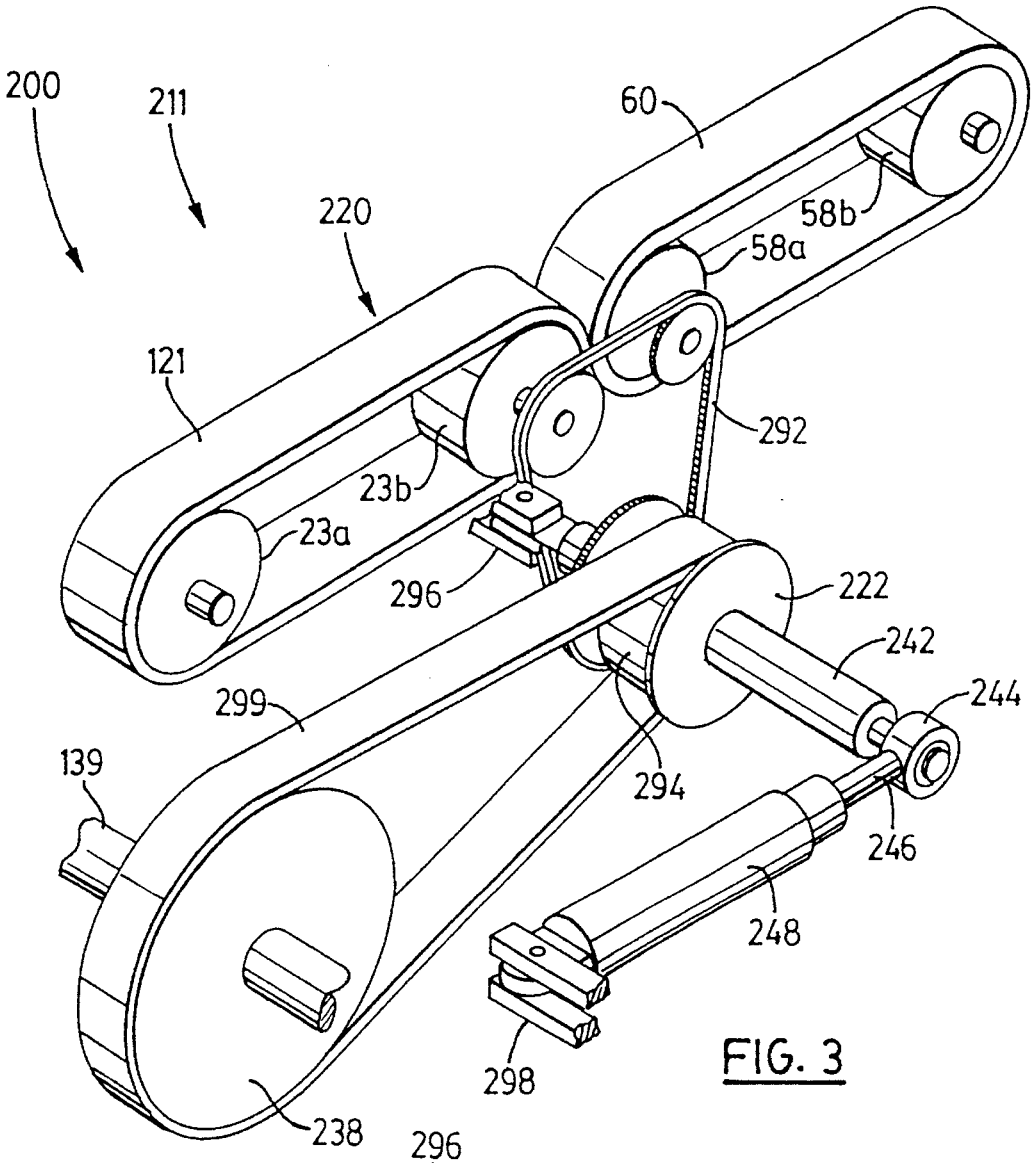
FIG. 3 is a fragmentary perspective view of apparatus made in accordance with a further aspect of this invention.

FIG. 3 illustrates a modification of the apparatus of FIG. 2. Turning to FIG. 3 wherein like numbers have been given to like parts of FIG. 2, apparatus 200 comprises feeders 211 having a conveyor 220 with an upstream feed belt 12 running on guide wheels 23*a*, 23*b* and a downstream feed belt 60 running on guide wheels 58*a*, 58*b*. Guide wheel 23*b* and guide wheel 58*a* are coupled to drive transmission wheel 222 by transmission belt 292. The drive transmission wheel rides on a shaft 242 supported at one end by pivot mount 296 and its other end by ring bearing 244 which terminates piston 246 of air cylinder 248. The piston of the air cylinder is biased to a retracted position shown in FIG. 3*a* by an internal spring in the cylinder (not shown). The base of the cylinder 248 is supported by pivot mount 298. The drive transmission wheel has a crowned face 294. A transmission belt 299 extends around the drive transmission wheel 222 and a drive wheel 238. The drive wheel 238 is mounted on shaft 139. The balance of apparatus 200 is identical to apparatus 10 of FIG. 1 and has not therefore been shown.

Figure 3A:
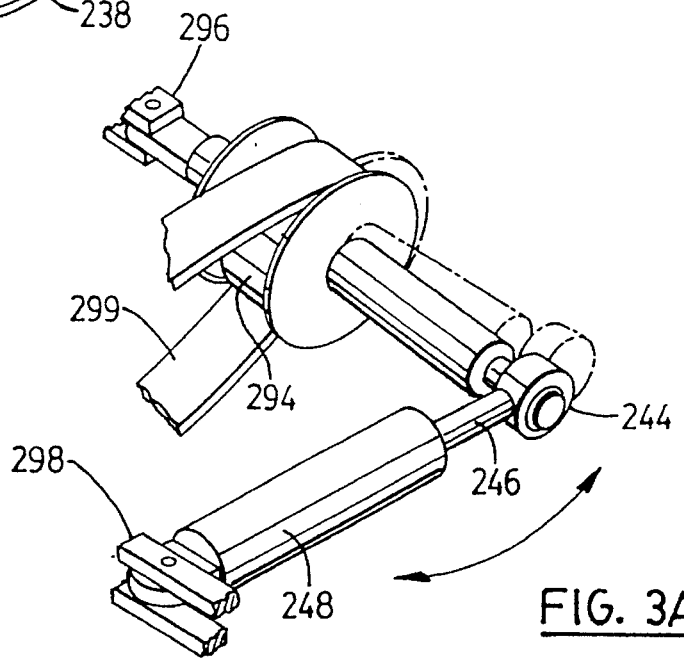
FIG. 3*a* is a fragmentary perspective view of the apparatus of FIG. 3 showing an aspect of the operation of the apparatus.

In operation of apparatus 200, when air cylinder 246 of a feeder 211 is vented to atmosphere, the piston 246 is in its retracted position so that drive transmission wheel 222 is in the tilted position shown in FIG. 3*a*. In this position, transmission belt 299 is loose so that drive wheel 238 does not motivate the belt. Consequently, drive transmission wheel 222 is not driven and the conveyor 220 is stationary. The controller (not shown) may operate a particular feeder 211 by coupling an air pressure source to the cylinder 248 of the feeder such that the piston 246 of the cylinder extends. This results in the cylinder pivoting about pivot mount 298 and the drive transmission wheel pivoting about pivot mount 296. The cylinder continues to extend until shaft 242 of the drive transmission wheel is parallel to shaft 239 of the drive wheel 238. In this position, shown in FIG. 3, transmission belt 299 is tightly stretched between the drive wheel 238 and the drive transmission wheel 222. With the transmission belt 299 stretched, the belt drives the drive transmission wheel, which in turn drives conveyor 220. The crowned face 294 of guide wheel 222 reduces wear on transmission belt 299 during the tilting of drive transmission wheel 222 to engage or disengage the drive transmission wheel from belt 292.

Figure 4:
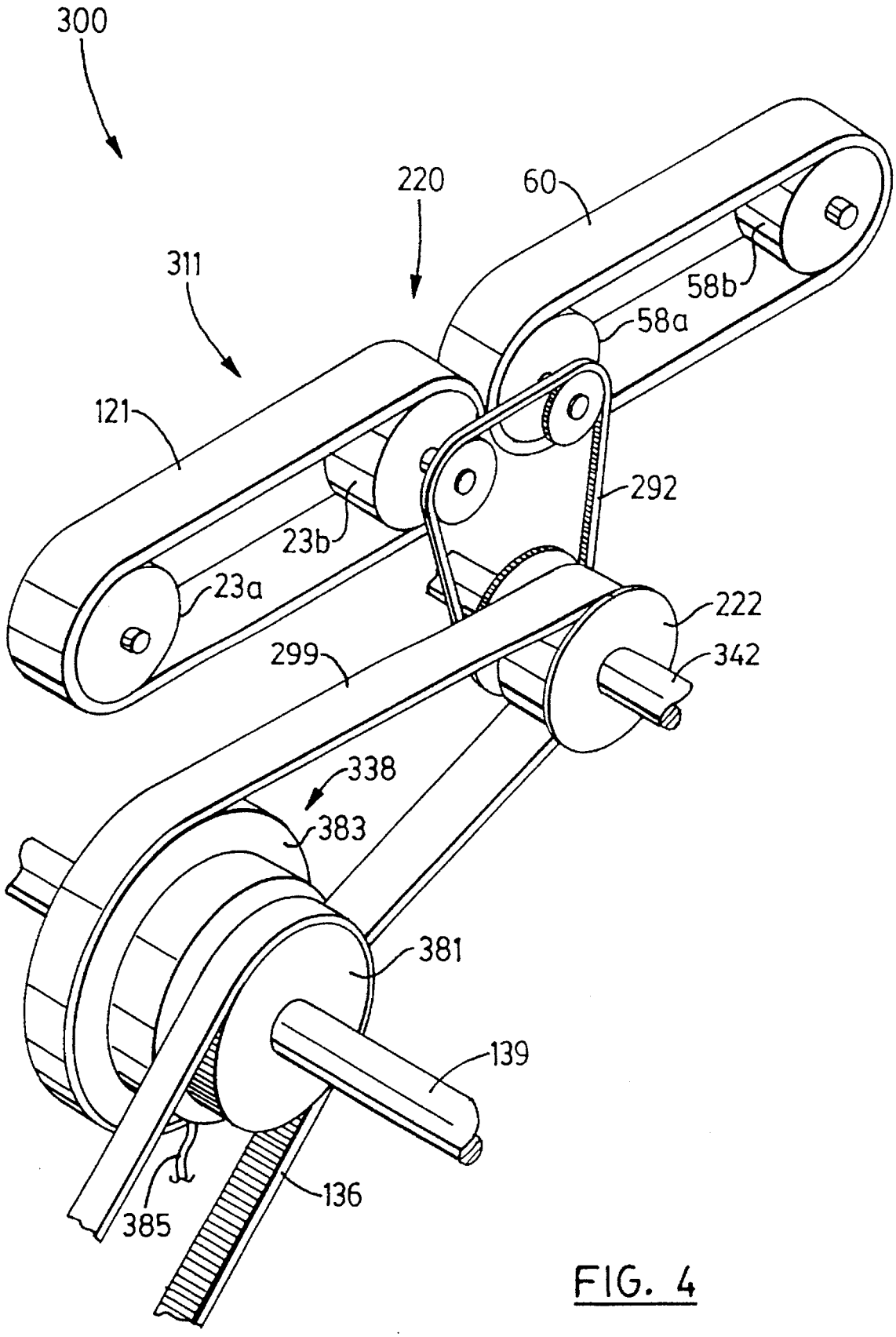
FIG. 4 is a fragmentary perspective view of apparatus made in accordance with a yet another aspect of this invention.

FIG. 4 illustrates a modification of the apparatus of FIG. 3. Turning to FIG. 4 wherein like numbers have been given to like parts of FIG. 3, apparatus 300 comprises feeders 311 having a conveyor 220 with an upstream feed belt 121 running on guide wheels 23*a*, 23*b* and a downstream feed belt 60 running on guide wheels 58*a*, 58*b*. Guide wheel 23*b* and guide wheel 58*a* are coupled to drive transmission wheel 222 by transmission belt 292. The drive transmission wheel rides on a shaft 342. A transmission belt 299 extends around the drive transmission wheel 222 and a clutched drive wheel 338 mounted on shaft 139. The clutched drive wheel comprises an input member 381 coupled to belt 136 and an output member 383. An electrical connector 385 runs from the clutched drive wheel to a controller (not shown). The balance of apparatus 300 is identical to apparatus 10 of FIG. 1 and has not therefore been shown.

In operation of apparatus 300, when clutched drive wheel 338 is de-energised, output member 383, and therefore, transmission belt 299, is idle. Consequently, drive transmission wheel is not driven and the conveyor 220 is stationary. The controller (not shown) may operate a particular feeder 211 by energising the clutched drive wheel through connector 385. This results in the output member 383 being coupled to the input member 381 so that the transmission belt 299, and therefore, the drive transmission wheel and conveyor 220, are driven.

Figure 5:
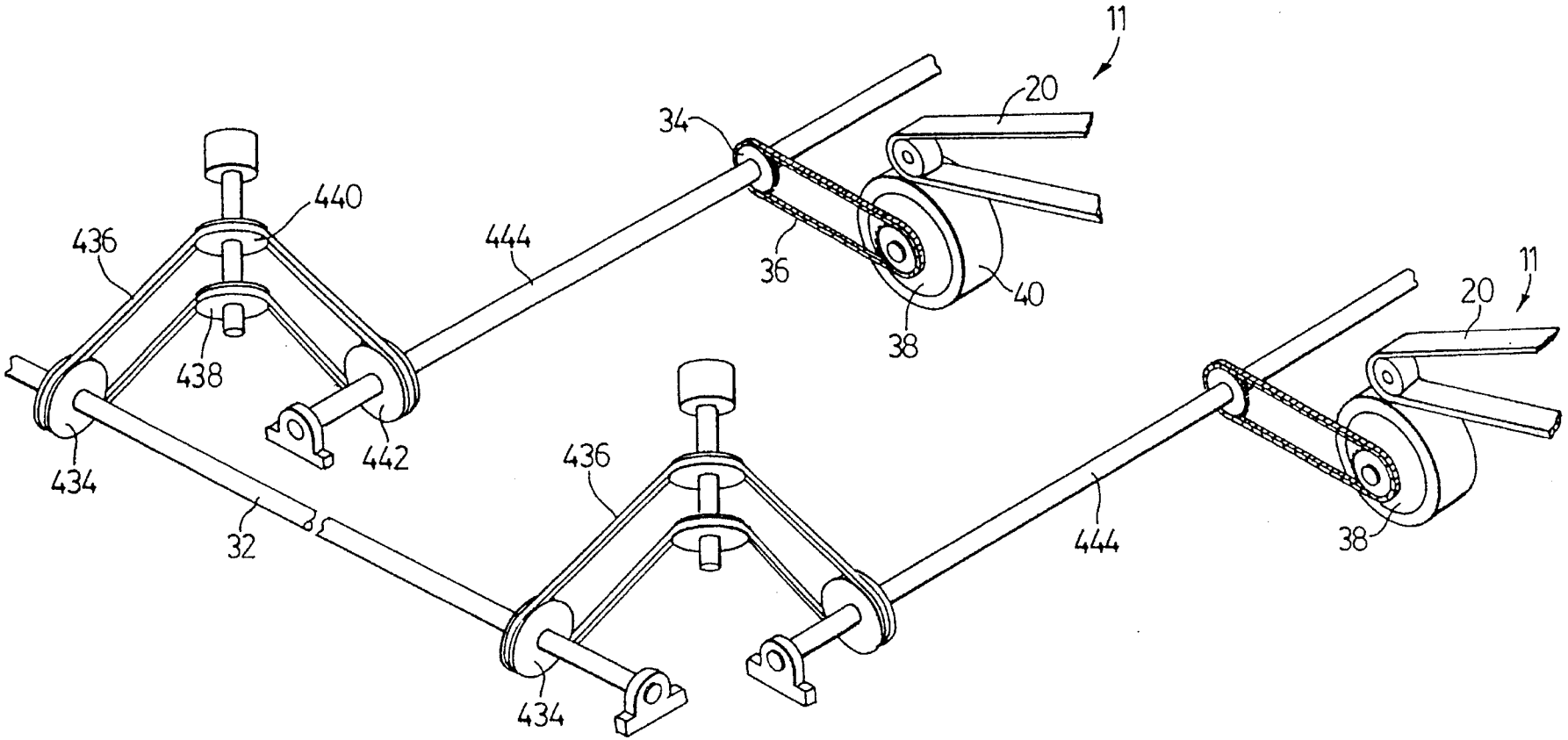
FIG. 5 is a fragmentary perspective view of another embodiment of the present invention.

The apparatus 10 of FIG. 1 feeds products 18 to a conveyor 14 which moves transversely of the downstream direction 90 in which the products 12 are fed by feeders 11. In order to feed the products to an in-line conveyor, the apparatus may be modified as shown in FIG. 5. With reference to FIG. 5, drive shaft 32 supports drive wheels 434. A drive belt 436 extends around each drive wheel 434 and over a pair of support wheels 438 and 440 to driven wheel 442. Driven wheel 442 is keyed to output shaft 444. A spur gear 34 is mounted to each driven shaft 444. As before, a chain belt 36 links the spur gear to a drive wheel 38, and a feed belt 20 of a feeder 11 is positioned over each drive wheel 38. The drive belt 436 changes the direction of torque imparted by drive shaft 32 by ninety degrees such that driven shaft 444 is normal to drive shaft 32. Consequently, product feeders 11 may be positioned in line with each other so that they will feed products in line.

Figure 6:
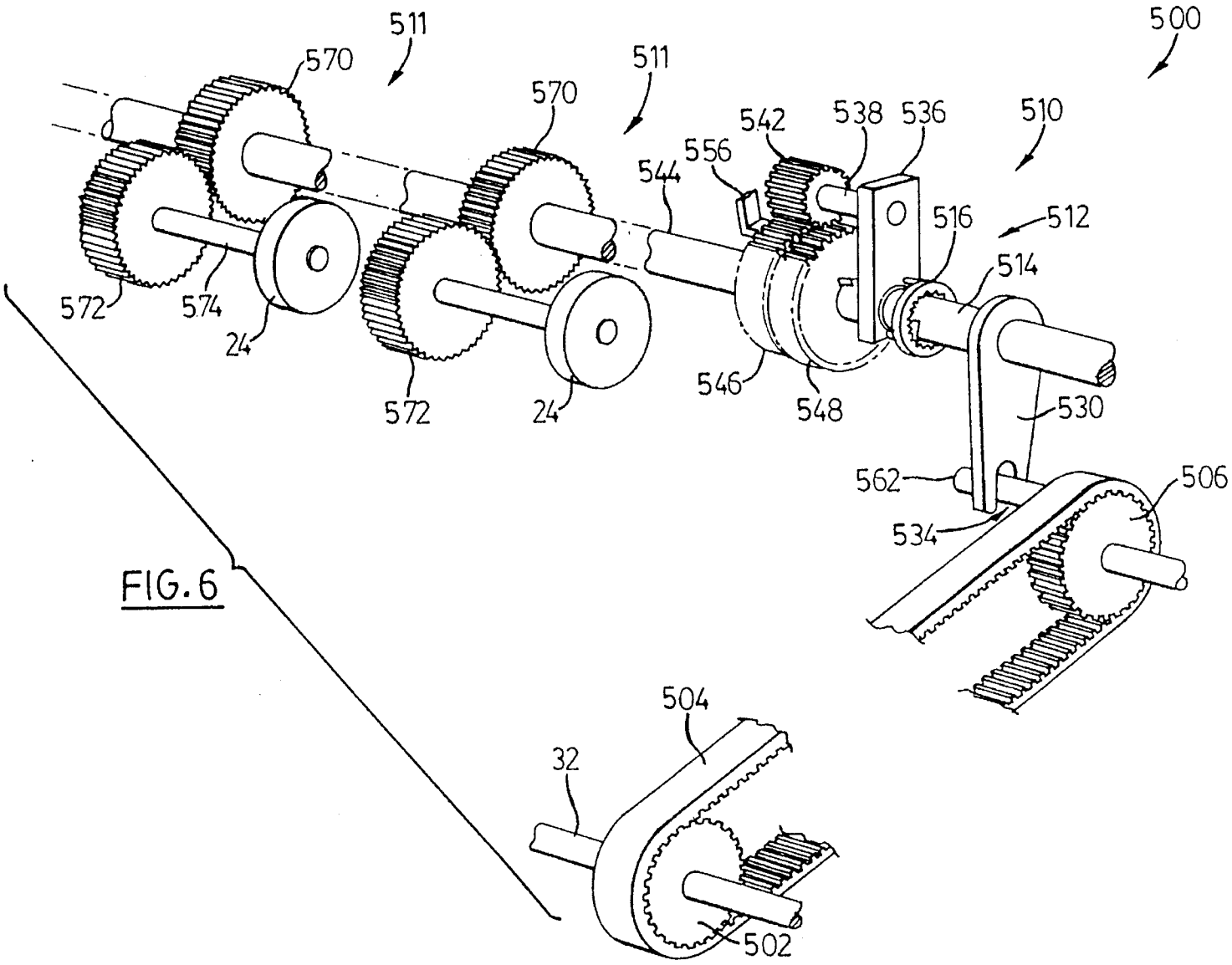
FIG. 6 is fragmentary perspective view of another embodiment of the present invention.

FIG. 6 illustrates another embodiment of this invention which avoids the need for stepping motors. With reference to FIG. 6, wherein like parts to apparatus 10 of FIG. 1 have been given like reference numerals, apparatus 500 has a toothed drive wheel 502 keyed to drive shaft 32. The teeth of the drive wheel 502 mesh with a drive belt 504. A toothed drive wheel 506 having an eccentric cam shaft 562 also meshes with the drive belt. The cam shaft 562 is received within a slot 534 of a pendulum 530 of gear transmission 510. Gear transmission 510 is of the type described in U.S. Pat. No. 5,385,509 issued Jan. 31, 1995, the contents of which are incorporated herein by reference. Gear t transmission 510 converts a constant rotary motion into a pulsed rotary motion. Briefly, gear transmission 510 comprises a one-way clutch 512 with pendulum 530 depending from the input shaft 514 of the clutch. A support arm 536 is supported by a sleeve bearing on clutch shaft 514 and is affixed to the output member 516 of the clutch. Arm 536 terminates in a shaft 538 which rotatably supports planetary spur gear 542. The planetary gear 542 meshes with sun gears 546 and 548 which are supported on an output shaft 544. Sun gear 546 is fixed against rotation by tag 556. Sun gear 548 is keyed to the output shaft 544 so that the shaft 544 rotates with sun gear 548. The clutch input shaft 514 is co-axial with the output shaft 544 but is not constrained to rotate with the output shaft.

Fixed sun gear 546 has a slightly different number of teeth than does rotatable sun gear 548. For example, the fixed gear 546 may have fifty-one teeth and rotatable gear 548 may have fifty teeth. Accordingly, planetary gear 542, and sun gears 546, 548 are set up as harmonic gears.

Spur gears 570 are keyed to the output shaft 544. Each spur gear 570 meshes with a spur gear 572. The feed wheel 24 of each feeder 511 is supported by a shaft 574 for rotation with a spur gear 572.

In operation of the gear transmission 510, when spur gear 506 moves through one revolution, eccentric cam shaft 562 rocks the pendulum 530 back and forth through one cycle. Since pendulum 530 is Joined to the input member 514 of one-way clutch 512, this input member 514 rotates alternately in a clockwise sense and then in a counterclockwise sense as the pendulum progresses through its cycle. The input and output members of the clutch lock together when the pendulum rocks in one sense and rotate arm 536, which depends from the output member of the clutch, through an arc which is determined by the eccentricity of cam 562.

Planetary gear 542 moves with support arm 536 and meshes with sun gears 546, 548. Since the fixed sun gear 546 and the rotatable sun gear 548 have a different number of teeth, as the planetary gear moves through an arc about the sun gears, the rotatable gear 548 is caused to rotate through a small part of a revolution. This operation of these harmonic gears will be well understood to those skilled in the art. Since the output shaft 544 is keyed to the rotatable sun gear 548, when gear 548 moves through a small part of an arc, the output shaft moves with it.

In the operation of the apparatus of FIG. 6, drive shaft 32 is continuously driven which, due to gear transmission 510, results in the output shaft 544 being pulsed at regular intervals. However, the feed wheel 24 of each feeder 511 is geared to the output shaft 544. Accordingly, the feed wheel 24 of each feeder is also pulsed through an arc at regular intervals. The apparatus 500 of FIG. 6 omits the stepping motors of FIG. 1 and the control lines to these motors and utilises gear transmission 510 instead otherwise, apparatus 500 is identical to the apparatus 10 of FIG. 1. Accordingly, a controller selectively activates the conveyors of feeders 511. Since the feed wheel 24 of each feeder 511 is regularly pulsed, it is certain that a product will be resting on the feed belt of the selected feeders for feeding downstream. On the other hand, regularly pulsing the feed wheels of each feeder will not normally drop more than one product onto the feed belt of idle feeders (i.e., feeders which are not selected for a period of time) due to the small space between the bottom of the stack of products and the upstream feed belt, which only accommodates one product. Further, at least provided each feeder is selected fairly regularly, the feed wheel 24 by itself will not have an opportunity to feed the bottom product by degrees through the nip between the upstream feed wheel and the feed belt.

Regularly pulsing the feed wheel 24 of a feeder with the apparatus of FIG. 6 could result in feeding more than product from the feeder 511 when it is selected if the feeder either carries thin product stock (such that the gap between the bottom of the stack and the feed belt can accommodate more than one product) or remains idle for a long period of time. To avoid improper feeding, feeders which could cause problems should be identified and the spur gear 572 associated with such feeders removed and replaced with a stepping motor which is under the control of the controller. This results in a hybrid machine, with the feed wheels of some feeders being regularly pulsed and the feed wheels of others being pulsed by stepping motors.

The apparatus of the present invention requires only one drive motor for the conveyors of the feeders. Avoiding individual drive motors for each feeder and the necessary power supply for each such motor can result in a per feeder cost saving of up to fifty percent.

Other modifications to the invention will be apparent to those skilled in the art and, therefore, the invention is defined in the claims.

What is claimed is:

1. Apparatus for selectively feeding products from a plurality of stacks thereof, comprising:

a plurality of stack guides;

a single drive for continuously rotating;

associated with each stack guide of said plurality of stack guides, a conveyor, a friction wheel spaced above said conveyor so as to provide a gap through which products may be singly fed from the bottom of a stack of products supported by said stack guide, means to pulse said friction wheel, and coupling means, when in a first state, coupling said conveyor to said continuously rotating drive in order to drive said conveyor and, when in a second state, decoupling said conveyor from said continuously rotating drive; and a controller for selectively causing a said coupling means associated with a stack guide of said plurality of stack guides to enter said first state, whereby said single drive is a common drive for each said conveyor.

2. The apparatus of claim 1 wherein said continuously rotating drive includes a plurality of drive wheels and including, for each of said stack guides, a drive transmission wheel operably coupled to said conveyor and wherein said coupling means comprises means to move said drive transmission wheel to a position such that said drive transmission wheel is driven by one drive wheel of said plurality of drive wheels.

3. The apparatus of claim 2 wherein said coupling means includes means for translating said drive transmission wheel into contact with said one drive wheel.

4. The apparatus of claim 3 wherein each of said plurality of drive wheels has a resilient face for contact by a drive transmission wheel.

5. The apparatus of claim 3 wherein said translation means comprises a cylinder having a piston connected to a bearing supporting said drive transmission wheel.

6. The apparatus of claim 5 wherein said translation means further comprises a source of air pressure coupled to said cylinder through a valve and wherein said controller is connected to a control input of said valve.

7. The apparatus of claim 2 where in said coupling means comprises a drive belt between said drive transmission wheel and said one drive wheel.

8. The apparatus of claim 7 wherein said coupling means further comprises a pivot mounting said drive transmission wheel to a support at a point along a rotational axis of said drive transmission wheel to allow said drive transmission wheel to tilt between a first position whereat said drive belt is in slipping engagement with said drive transmission wheel and a second position whereat said drive belt is in driving engagement with said drive transmission wheel.

9. The apparatus of claim 8 wherein said drive transmission wheel has a crowned face.

10. The apparatus of claim 8 wherein said coupling means comprises a cylinder having a piston connected to a bearing supporting said drive transmission wheel spaced from said pivot mount.

11. The apparatus of claim 10 wherein said coupling means further comprises a source of air pressure coupled to said cylinder through a valve and wherein said controller is connected to a control input of said valve.

12. The apparatus of claim 2 wherein said coupling means comprises a cylinder having a piston connected to a bearing supporting said drive transmission wheel.

13. The apparatus of claim 12 wherein said coupling means further comprises a source of air pressure coupled to said cylinder through a valve and wherein said controller is connected to a control input of said valve.

14. The apparatus of claim 13 including means to bias said piston to a position whereat said drive transmission wheel is not driven by said one drive wheel.

15. The apparatus of claim 12 wherein said coupling means further comprises a source of air pressure and a valve, said source of air pressure and said cylinder being coupled to said valve, said valve also having a vent to atmosphere, said controller being connected to a control input of said valve in order to couple one of said vent and said source of air pressure to said cylinder.

16. The apparatus of claim 2 including a product sensor for sensing a product at a pre-determined location on said conveyor, said product sensor having an output operatively associated with said controller for prompting said controller to deactivate said coupling means in order to decouple said conveyor from said continuously rotating drive.

17. The apparatus of claim 1 wherein said means to pulse said friction wheel comprises a stepping motor and wherein said controller is for activating a stepping motor associated with a stack guide of said plurality of stack guides when causing a coupling means associated with said stack guide of said plurality of stack guides to enter said first state.

18. The apparatus of claim 1 including a product sensor for sensing a product at a pre-determined location on said conveyor, said product sensor having an output operatively associated with said controller for prompting said controller to deactivate said coupling means in order to decouple said conveyor from said continuously rotating drive.

19. A method of selectively feeding products from a plurality of product feeders of the type having a stack of products, comprising the following steps, continuously rotating a drive shaft having a plurality of drive wheels mounted for rotation therewith;

selecting at least one feeder and moving a drive transmission wheel operatively associated with a conveyor of each selected feeder such that said drive transmission wheel moves into a driven relationship with an associated one of said plurality of drive wheels and is thereby driven;

stepping a friction wheel spaced above the conveyor of each selected feeder so that a product from a stack of products associated with said friction wheel is fed from the bottom of said stack into a gap between said friction wheel and said conveyor.

20. The method of claim 19 including the step of moving said drive transmission wheel of each selected feeder such that said drive transmission wheel is not in a driven relationship with said associated one of said plurality of drive wheels after a product is fed from the bottom of the stack associated with each selected feeder.

21. The method of claim 19 including, for each selected feeder, the step of sensing a product dispensed through a gap between said friction wheel and said conveyor and moving the drive transmission wheel associated with said conveyor out of a driven relationship with said associated one of said plurality of drive wheels in response to said sensing.

* * * * *